United States Patent [19]

Alibeckoff

[11] 3,974,319

[45] Aug. 10, 1976

[54] ALL PURPOSE WIPE MATERIAL

[75] Inventor: Galib-bey Atam Alibeckoff, Lakewood, Ohio

[73] Assignee: Nylonge Corporation, Cleveland, Ohio

[22] Filed: Feb. 4, 1974

[21] Appl. No.: 439,589

[52] U.S. Cl. ..... 428/283; 15/209 R; 427/339; 427/365; 427/434; 428/234; 428/288; 428/300; 428/910

[51] Int. Cl.[2] ..... A47L 13/16; A47L 17/00

[58] Field of Search ..... 161/153, 154, 155, 158, 161/170, 267, 232; 117/135.5; 428/235, 280, 301, 281, 282, 288, 910; 156/77, 78, 79; 427/246, 339, 365, 434 R; 15/209 R

[56] References Cited

UNITED STATES PATENTS

| | | | |
|---|---|---|---|
| 2,338,960 | 1/1944 | Nottebohm | 154/40 |
| 2,834,703 | 5/1958 | Atkinson | 161/153 X |
| 3,051,171 | 8/1962 | Liloia et al. | 161/154 |
| 3,317,367 | 5/1967 | Keller | 161/67 |
| 3,366,532 | 1/1968 | Markey et al. | 161/159 |
| 3,509,020 | 4/1970 | Gelcomino | 161/267 X |
| 3,660,222 | 5/1972 | Fleming et al. | 161/170 X |
| 3,661,674 | 5/1972 | Higgs et al. | 161/159 X |
| 3,663,348 | 5/1972 | Liloia et al. | 161/170 X |
| 3,728,207 | 4/1973 | Heling | 161/170 X |
| 3,834,978 | 9/1974 | Nisenson | 161/154 X |
| R27,820 | 11/1973 | Politzer et al. | 156/78 |

*Primary Examiner*—James J. Bell

*Attorney, Agent, or Firm*—Leydig, Voit, Osann, Mayer & Holt, Ltd.

[57] ABSTRACT

A soft, absorbent nonwoven material useful as an all purpose wipe is disclosed. The material includes a three dimensional web of an open array of long fibers, a minor fraction of which have Z-direction orientation and regenerated cellulose fragments. The regenerated cellulose fragments are randomly dispersed throughout the web of fibers with the concentration of regenerated cellulose being greatest on and adjacent to the web surfaces and diminishing toward the web mid section. The fragments are adhered to the long fibers and, in combination with the Z-direction oriented fibers, unite the web into a coherent material.

7 Claims, 5 Drawing Figures

ALL PURPOSE WIPE MATERIAL

The present invention relates to novel nonwoven materials and, in particular, materials which are suitable as all purpose wipes which possess the attributes of woven cloth. The invention is especially concerned with providing a disposable wipe material for use in industrial applications.

The launderable cloth industrial towel and rags salvaged from discarded clothing and the like constitute the principal wipe market as such exists today. The launderable towel has generally good wiping properties and high fluid retention capacity. However, it lacks uniformity, usually contains residual oils, and, perhaps most importantly, may contain metal chips or the like abrasive materials which can adversely affect persons using the wipe or sensitive wipe surfaces such as printing plates or rolls. As to rags, these are generally nonuniform in size, composition and wiping properties. Moreover, with the increasing use of hydrophobic synthetic fibers in fabric manufacture, the use of rags as fluid wipes is generally decreasing.

A disposable wipe material which could be inexpensively manufactured would be highly desirable. Heretofore, the problem has been in providing such a disposable material which simulates launderable cloth with respect to softness and wiping characteristics and which also possesses adequate strength for all wipe applications. While disposable fabrics have been suggested as wipes for certain applications, problems have generally been encountered when the objective is to provide an "all purpose" wipe which is useful for (1) wiping oils, (2) solvent cleaning and (3) wet wiping. The difficulty arises since each of these types of wipe applications require generally different product characteristics.

Use of oil wipes is most frequently encountered in general machine shop applications for cleaning machinery, parts and operator's hands. The wipe must have a small pore structure to permit the capillaries to exert a high force to remove oil or other liquids. It must also have a high fluid capacity. Moreover, since the wipe is ordinarily dry when use is initiated, it should be soft and conformable, presenting a cotton-like feel in order to subjectively indicate absorbency. These latter features are customarily lacking in many disposable wipes which possess a plastic-like surface feel due to the presence of binders.

Solvent wipes are frequently used in the printing industry and in cleaning metal surfaces prior to painting. The wipes are generally presaturated with a solvent, the saturated wipe then being rubbed over the surface to be cleaned with the solvent being squeezed out by the rubbing action. The wipe then must reabsorb the squeezed out solvent and dissolved material. A dry wipe is then commonly used to dry the clean surface. As is apparent, the solvent wipe must hold a large volume of solvent, release the solvent under pressure and then re-absorb most of it while at the same time being resistant to solvent attack.

Wet wipes are used in basically three applications. The first is similar to the above described solvent wiping except that the wipe is presaturated with a soapy water solution rather than a solvent and is used to remove dirt and water soluble stains. Wipes used to absorb large volume spills, e.g. drinks, are also generally termed wet wipes although initially used in the dry state. These wipes need a high fluid retention capacity and also must permit the squeezing out of a major portion of absorbed liquid in order to permit reuse. Reuse, of course, avoids the necessity of using a second dry wipe to effectively clean up the spill. A final "wet" wipe application is that termed "wet dusting". Such a wipe must simply hold a small amount of fluid which then acts as a glue for dust particles and the like which are to be removed from a surface.

U.S. Pat. Nos. 3,317,367 (Koller) and 3,366,532 (Maskey and Cox) and Swedish pat. specification No. 327,821 (Lindquist) illustrate various wipe materials including structures bonded with regenerated cellulose. U.S. Pat. No. 3,657,035, reissued as Re. 27,820 (Politzer, Alibeckoff and Wang) illustrates the preparation of laminates of a reticulated regenerated cellulose layer and layers of cellulose fibers which are stated to be improved cleaning and wiping articles.

Among some of the major problems which have been encountered in providing a suitable all purpose wipe are the inability to provide a soft, dry cloth-like material which is resistant to solvents, has very little tendency to lint, has adequate surface abrasion resistance to last through its intended use, and has adequate wet body. As to this latter characteristic, the wipe must be capable of retaining its sheet-like characteristics when wet and not wad or otherwise become an unusable mass of material requiring unfolding and the like.

The principal object of the present invention resides in providing an improved disposable all purpose wipe material which closely simulates launderable cloth in its softness and wiping characteristics.

In connection with the principal object, an important object of the present invention is to provide a soft, dry nonwoven, solvent resistant material which can absorb and hold large volumes of water, oil or solvent, and which is sufficiently compressible so that liquids absorbed therein can be efficiently squeezed out.

Related to this object is the further objective of providing a disposable wipe material which, after squeezing when wet, substantially reassumes its original form so as to be capable of again absorbing and holding large volumes of liquid.

An additional important object lies in providing a nonwoven disposable wipe material which is highly conformable both to the hand of the user and to the wipe surface.

Yet a further object resides in providing a strong nonwoven wipe material which is substantially lint free, abrasion resistant and which possesses a functionally useful wet body.

Still another objective of the present invention is to provide an inexpensive and commercially feasible process for preparing disposable wipe materials having the above-identified sought after attributes.

Other objects and advantages of the present invention will be apparent as the following description proceeds, taken in conjunction with the accompanying drawings, in which.

Figure 1:
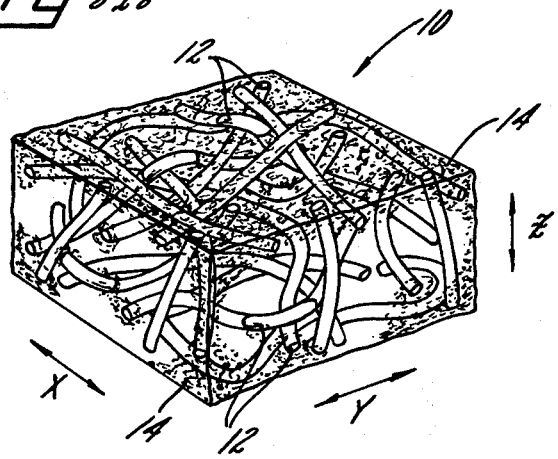
FIG. 1 is a schematic, highly idealized, fragmentary perspective view of a material constructed in accordance with the invention.

While the present invention is susceptible of various modifications and alternative constructions, there is shown in the drawings and will herein be described in detail the preferred embodiments. It is to be understood, however, that it is not intended to limit the invention to the specific forms disclosed. On the contrary, the invention is to cover all modifications and alternative constructions falling within the spirit and scope of the invention as expressed in the appended claims.

Turning now to the drawings, a soft, absorbent nonwoven material 10 constructed in accordance with the invention is illustrated in a highly idealized fashion in FIG. 1. The wiping surfaces of the material 10 are defined by the two outermost X-Y planes of the illustrated structure with the material thickness lying in the Z-direction. The material 10 consists essentially of a three dimensional web of an open array of long fibers 12 adhered together by regenerated cellulose fragments 14 to form a coherent structure.

The fibers 12 of the web are randomly arranged in an open array with a predominant number thereof lying substantially in the X-Y planes of the material in order to provide good strength characteristics in the basic sheet directions. However, it is an important aspect of the present invention that a minor fraction, e.g., about 5–25%, of the fibers 12 have substantial Z-direction orientation intersecting the X-Y planes of the material. In addition to integrating the material so as to provide delamination resistance and abrasion resistance, the presence of such Z-direction oriented fibers is also believed to contribute to several other desirable features of the material. Being oriented out of the basic sheet direction, the fibers provide desirable material resiliency contributing to softness and also aid in preventing collapse of the open array when the material is wetted.

Figure 3:
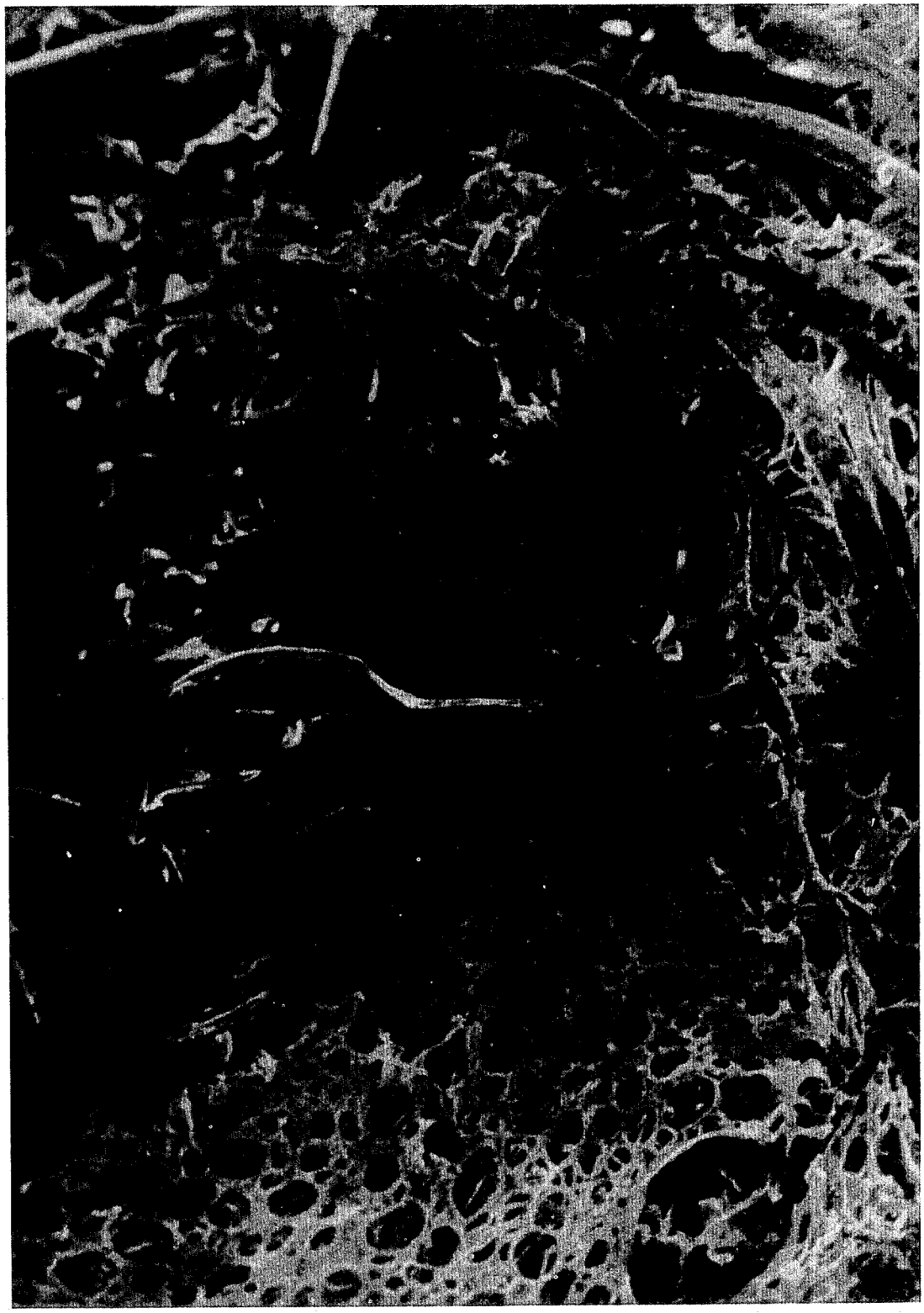
FIG. 3 is a photomicrograph taken at 80X magnification of a portion of the surface of material prepared in accordance with the present invention.
Figure 4:
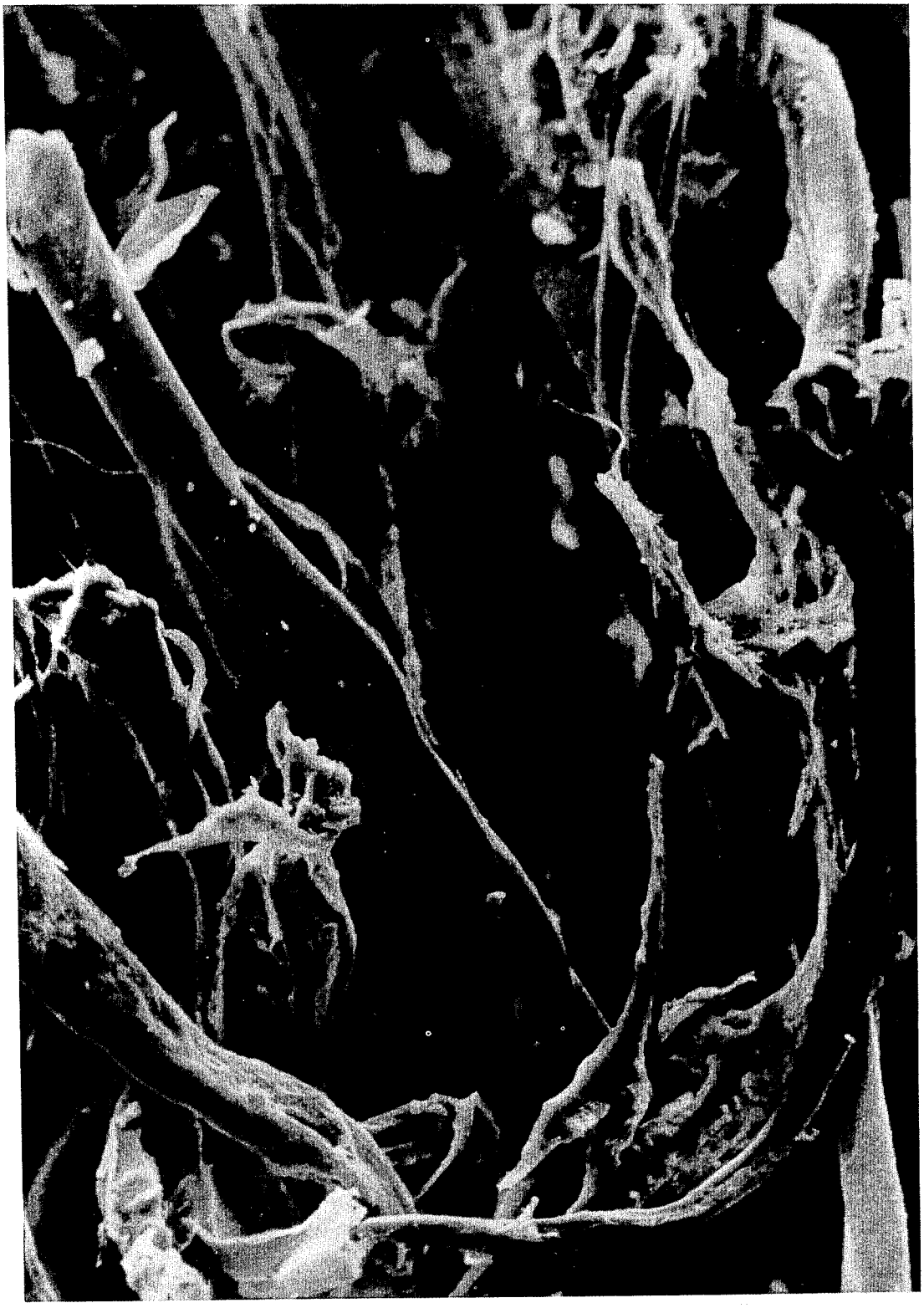
FIGS. 4 and 5 are photomicrographs taken at 300X magnification of a cross section of a central portion of material prepared in accordance with the present invention.
Figure 5:
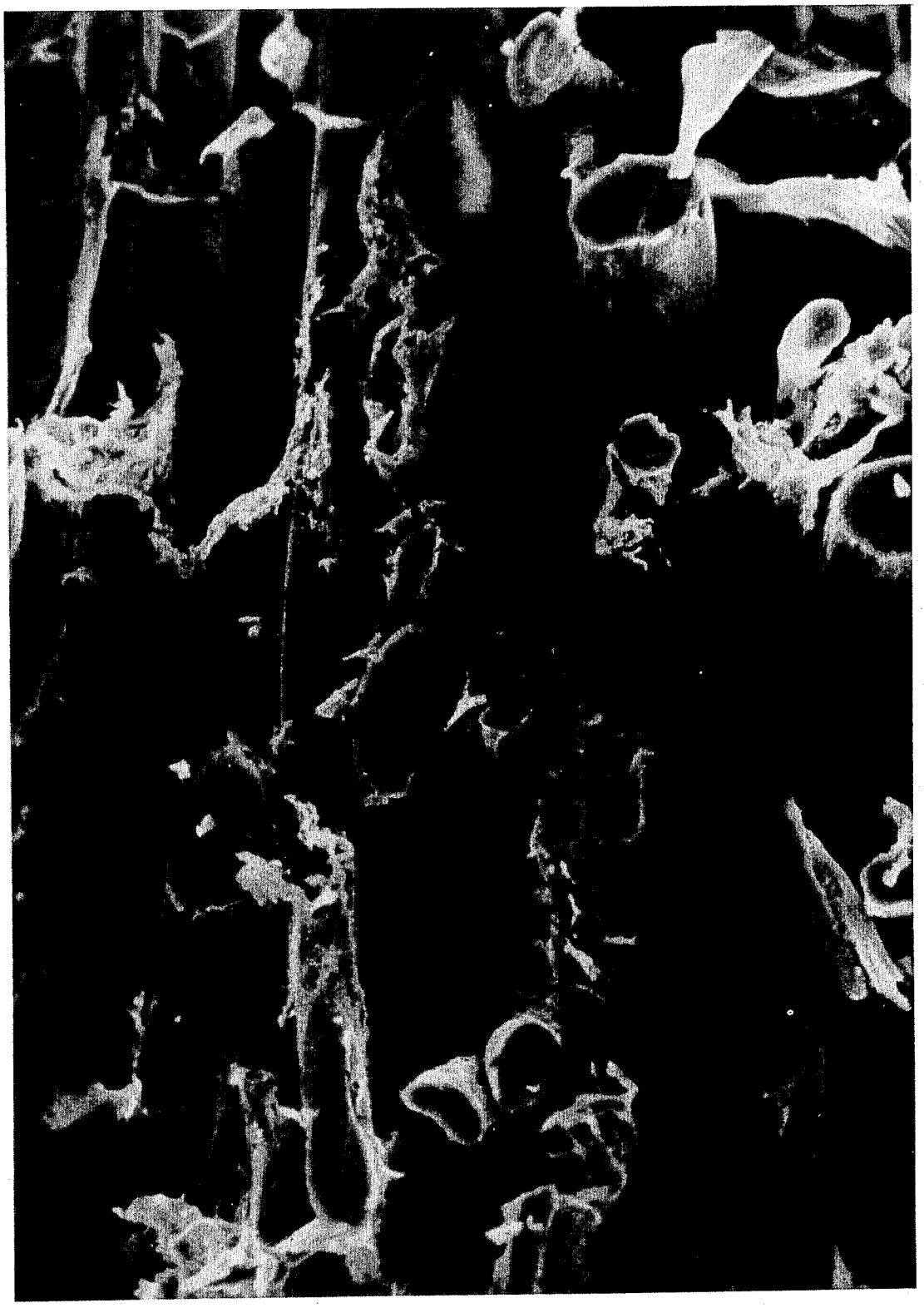

Turning specifically to the regenerated cellulose fragments 14, the nature of the fragments as well as their distribution in the material are important features of the illustrated material. As is evident from the photographs, the regenerated cellulose is, indeed, present as fragments as distinguished from a continuous network throughout the material. On the other hand, as illustrated in FIG. 3, the individual fragments are larger and are highly reticulated and porous in structure on and adjacent to the surfaces of the material as contrasted with the center region where less reticulated and smaller fragments are present (FIGS. 4 and 5). While the bonding which is achieved by adherence of the fragments to the fibers is adequate to provide a useful wipe, the fact that the cellulose is present as fragments, having a fine reticulated structure contributes to softness and conformability of the material.

Referring to FIGS. 1 and 3–5, it will be noted that the regenerated cellulose fragments are dispersed in a random fashion throughout the open array of fibers. However, as illustrated schematically in FIG. 1, the fragment size and concentration of regenerated cellulose is greatest in those regions at and adjacent to the wiping surfaces and progressively diminishes toward the mid section of the material. Due to the greater concentration of regenerated cellulose at the surface and associated increased fiber bonding, the material has good surface abrasion resistance. The diminished degree of bonding in the central region, due to the lower concentration of regenerated cellulose, enhances conformability and drapability of the material.

While there is a diminished intensity of bonding toward the mid section of the material, it should be appreciated that, due to the presence of Z-direction oriented fibers extending across the mid section, the material of the present invention is in fact an integrated, coherent single web.

As is evident from the above description, the soft, absorbent product of this invention consists of two essential constituents, i.e., a three dimensional web of an open array of long fibers, a fraction of which have Z-direction orientation, and regenerated cellulose fragments. It should be noted that, as opposed to many regenerated cellulose containing materials, the present product is soft when dry — there being no necessity for including customary liquid softening agents or humectants. The product is also distinguishable from many conventional nonwoven materials which include wet laid tissue and the like highly compacted, i.e., nonopen, fibrous webs as necessary components. It is similarly to be distinguished from those nonwoven products which necessarily include one or more plies of fibrous webs integrated together by means of a laminating adhesive material or the like. In contrast to the above types of structures, the present materials have the desirable combination of softness, conformability, strength, and absorbency characteristics which permit them to function very advantageously as all-purpose wipe materials.

However, it should be understood that products of the present invention can contain ingredients or constituents other than the fibers and fragments so long as the presence of such added elements does not substantially detract from the desirable product attributes described herein. For example, for ease in processing, the open array of fibers can be lightly prebonded after formation with a suitable adhesive in amounts up to, for example, about 25%, based on the long fiber weight. The use of webs which contain, in addition to the fibers, such adhesives also results in a desirable increase in abrasion resistance, particularly when the regenerated cellulose is present in a low concentration.

A general manner of preparing the products of the present invention involves initially forming a fibrous web having the characteristics above described, impregnating the formed web with a viscose solution and thereafter regenerating the viscose in a manner which results in the above described fragment formation.

Concerning initial web formation, it is important that the web be mostly fashioned from long, textile-length fibers rather than the short fibers customarily used in paper making applications. In this respect, webs prepared from textile fibers predominantly having a length of about ¼–2 inches, preferably, ½–1 inch, are most useful. Inclusion of substantial quantities, e.g., more than 50% and generally more than 25%, of shorter fibers leads to undesirable linting of the resultant product and requires excessive quantities of regenerated cellulose in order to effectively bond the structure. This, in turn, adversely affects product softness and conformability. In this respect, products having the desirable attributes identified herein have a regenerated cellulose content of about 10–50%, preferably, 25–40%, based on the web weight. Also the use of long fibers enhances the integrity of the web particularly in the Z-direction.

While fibers longer than about 2 inches can be used, it is economically unattractive to prepare webs containing such fibers in substantial quantities. Webs prepared from normally hydrophilic fibers such as wool, cotton, rayon, etc., are preferred though the web can also contain hydrophobic synthetic fibers such as acrylics, polyesters, polyolefins, etc. The fibers have a denier of less than about 15 and, preferably, less than about 6. Conventional waste fiber stock is generally preferred for use herein due to its inexpensiveness.

Airlaying techniques such as random web forming are generally suitable for preparing the initial open array of fibers. When webs are formed in such a manner at basis weights in excess of about 30 grams/yd.$^2$, the requisite fiber distribution and orientation discussed previously is achieved, though for wipe applications a basis weight of at least about 60 grams/yd.$^2$ is preferred. From an economic viewpoint, there is little incentive for preparing wipes with webs having a basis weight in excess of about 150 grams/yd.$^2$ and generally in excess of 100g/yd.$^2$. It is also within the scope of the present invention to utilize a web which, after formation, is further integrated such as by needling or the like. Such webs can be easily handled without supplemental adhesives and the finished material exhibits particularly outstanding surface abrasion resistance.

Figure 2:
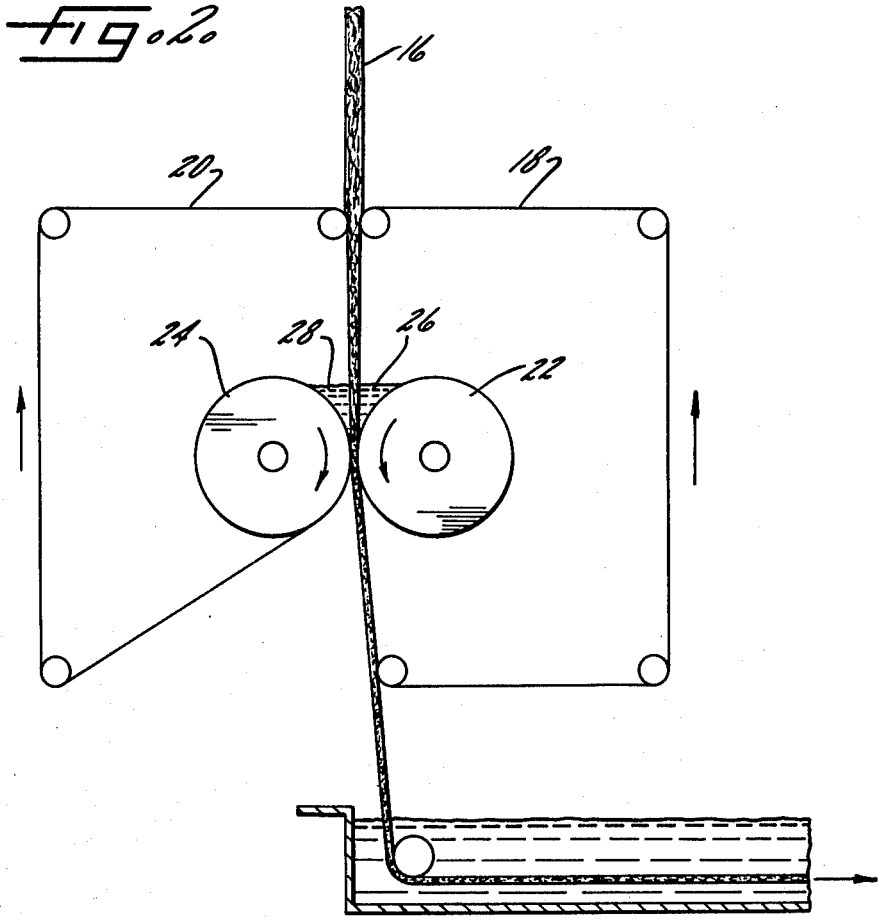
FIG. 2 is a schematic illustration of one manner in which materials embodying the features of the present invention can be prepared.

After formation of the base fiber web, impregnation of the web with a viscose solution can be effected. As illustrated in FIG. 2, a preferred method for accomplishing this involves sandwiching the web 16 between two driven screens 18, 20 and then vertically passing the sandwiched structure between two squeeze rolls 22, 24. As the sandwiched structure passes between the squeeze rolls, viscose contained in the pools 26, 28 located above each squeeze roll is forced into the web with the viscose concentration gradually diminishing toward the web mid section. The screens support the web as it is impregnated and, once impregnation has been effected, the screens are removed from the impregnated web. If, as indicated previously, the web 16 is lightly prebonded or further integrated, use of the screens may not be needed.

In order to conveniently effect impregnation and to achieve fragment formation in the manner hereinafter described, the viscose used in connection with the process illustrated in FIG. 2 should be in a highly foamed state. As described in U.S. Pat. No. 3,657,035 (Re. 27,820) viscose solutions having a high alkalinity (a weight ratio of sodium hydroxide to viscose cellulose exceeding 0.9:1.0 and, preferably at least 1:1) and containing a surfactant can be readily foamed even at high viscose cellulose concentration, e.g. 7% by weight and above. Furthermore, it has been found that exceptionally soft materials embodying the attributes of the present invention can be provided by utilizing a viscose foam wherein, at xanthation, a high $CS_2$ concentration, e.g., greater than 40% based on $\alpha$-cellulose, is present.

As compared with ordinary viscose solutions which have a specific gravity of about 1.12, viscose foam used in the present process desirably has a specific gravity between about 0.15 and 0.6 and contains a high concentration of very fine air bubbles. While the most useful and preferred foams contain about 6–8% dissolved viscose cellulose, foams with lower concentrations formed at lower alkalinity can also be used, particularly when the long fiber web has a high basis weight.

Referring still to FIG. 2, after viscose foam impregnation, the viscose in the web is then coagulated and regenerated in a manner such that the product having the desirable characteristics with respect to regenerated cellulose fragment formation and distribution is obtained. Accordingly, in keeping with the present invention, coagulation and regeneration are accomplished by passing the web through a hot, e.g. 75°–100°C., preferably 95°–100°C., aqueous solution containing about 10 to 30% sodium sulphate and about 0.5 to 15% sulphuric acid.

While the precise mechanism of fragment formation which occurs on regeneration is not fully understood, it is believed that regenerated cellulose fragment formation is attributable to the fact that the viscose is present as a foam and that regeneration is effected at a high temperature. Being foamed with the accompanying inclusion of substantial quantities of fine air bubbles permits rapid penetration of hot acid into the web interior. Furthermore, the hot acid also expands the air inside the bubbles which accellerates the rate of penetration of acid and contributes to fine reticulated fragment formation. In turn, this effects rapid release of gas accompanying regeneration which effectively "explodes" the viscose into fine fragments of regenerated cellulose. In addition to fragment formation, the described process of regeneration is also believed to open up the material, thus enhancing its softness and its capacity for absorbing and holding fluids.

Subsequent to regeneration, the material containing the cellulose fragments can be subjected to conventional washing, bleaching and drying techniques. In addition, the softness and absorbency characteristics of the material can be further enhanced by suitable embossing or other like techniques. Additional softening is particularly desirable when the product is dried by passage over hot cans or the like which tend to consolidate the web. For wipe applications, materials having a Z-direction thickness of about 0.035 inch –0.065 inch are preferred.

EXAMPLE

A web having a basis weight of about 65 grams/yd.$^2$ and 42 inches wide was prepared using a Rando Webber (Curalator Corp.) from conventional waste fiber stock (50% cotton, 10% rayon, 40% polyester — average fiber length about 0.75 inch spread, about ⅓ inch–1 inch). The web so formed was lightly prebonded by spraying with "Geon" 576 adhesive with an adhesive add-on of about 14 grams/yd.$^2$ and heated to effect drying.

Using a process such as schematically illustrated in FIG. 2, the web was then impregnated with viscose foam having a specific gravity of about 0.34. Prior to foaming, 0.5%, based on viscose weight, of "Triton" BG 10 surfactant was added to the viscose. Foaming was accomplished by air injection using a "VOTATOR" line mixer. The unfoamed viscose had a specific gravity of about 1.1 and contained water, about 7% dissolved cellulose, 10.5% NaOH, and 1.8% xanthate sulfur (2.6% total sulfur).

Viscose impregnation was effected at a speed of about 15 feet/min. using 12 inch diameter, 46 inch long neoprene rubber covered rolls (about 60 durometers) in pressure contact provided by 60 psig compressed air using a 3 inch diameter piston. 44 inch wide stainless steel screens were used having a wire diameter of 0.065 inch and 32 × 32 mesh.

After impregnation, the material was passed at 15 feet/minute for about 30 feet through an aqueous coagulation regeneration bath maintained at about 96° C. which contained 22% sodium sulfate, 60 grams/liter $H_2SO_4$ and had a specific gravity of about 1.25 at 35°C. Thereafter and in conventional fashion, the web can be passed through a dilute acid post regeneration and acid recovery both, deacidified with water, desulfurized with a $Na_2S$, NaOH solution, washed, bleached, washed again and finally can be dried by passage through a hot air impingement oven.

The product so prepared containing 28% regenerated cellulose fragments based on prebonded web is illustrative of a material which fully satisfies the aims and objectives of the present invention. The material is soft, conformable and possesses those desirable attributes heretofore identified which render it very suitable as an all-purpose wipe. The principal fiber bonding agent is the porous regenerated cellulose which is absorbent itself and consequently the material has highly advantageous fluid wiping characteristics. And, by being distributed therein in the described fragmentary manner, the material is soft and conformable. Where additional softness is especially desirable, the material can be lightly pin embossed, dry creped, etc to accentuate this feature.

1. A soft, absorbent nonwoven material consisting essentially of a three dimensional web of an open array of long textile fibers, a fraction of which have substantial Z-direction orientation relative to the generally planar outer web surfaces and, based on the weight of the web, 10–50% regenerated cellulose, said regenerated cellulose being present as fragments randomly dispersed throughout the web with the concentration of regenerated cellulose being greatest on and adjacent to said outer web surfaces and of diminished concentration toward the web mid section, said fragments being adhered to said long fibers to, in combination with the Z-direction oriented fibers, unite the web into a coherent material.

2. The material of claim 1 wherein the three dimensional web is an air laid web of substantially randomly deposited fibers.

3. The material of claim 2 wherein the air laid web is lightly pre-bonded.

4. The material of claim 2 wherein the air laid web is needled.

5. The material of claim 2 containing, based on the weight of the web, 25–40% regenerated cellulose.

6. The material of claim 5 wherein the air laid web has a basis weight of about 60–100 g./yd.$^2$.

7. The material of claim 6 wherein the air laid web is lightly pre-bonded.

* * * * *